US007941078B2

(12) United States Patent
Bae et al.

(10) Patent No.: US 7,941,078 B2
(45) Date of Patent: May 10, 2011

(54) ELECTROPHOTOGRAPHIC IMAGE FORMING APPARATUS HAVING TRANSPARENT TONER

(75) Inventors: Hyun-wook Bae, Yongin-si (KR); Ki-jae Do, Suwon-si (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 698 days.

(21) Appl. No.: 11/773,662

(22) Filed: Jul. 5, 2007

(65) Prior Publication Data

US 2008/0152391 A1 Jun. 26, 2008

(30) Foreign Application Priority Data

Dec. 26, 2006 (KR) ..... 10-2006-0134157

(51) Int. Cl.
*G03G 15/01* (2006.01)

(52) U.S. Cl. ..... 399/231; 399/299; 399/300

(58) Field of Classification Search ..... 399/223, 399/231, 298, 299, 300
See application file for complete search history.

(56) References Cited

U.S. PATENT DOCUMENTS

| | | | | |
|---|---|---|---|---|
| 5,009,973 | A * | 4/1991 | Yoshida et al. | 430/119.84 |
| 5,122,843 | A * | 6/1992 | Yokoyama et al. | 399/231 |
| 5,915,144 | A * | 6/1999 | Ide et al. | 430/45.3 |
| 6,122,473 | A * | 9/2000 | Goseki et al. | 399/286 |
| 6,389,260 | B1 * | 5/2002 | Kataoka et al. | 399/298 |
| 6,678,493 | B2 * | 1/2004 | Maeyama et al. | 399/302 |
| 2005/0214669 | A1 * | 9/2005 | Hayashi et al. | 430/109.4 |
| 2006/0127134 | A1 | 6/2006 | Sakamaki et al. | |

* cited by examiner

*Primary Examiner* — David P Porta
*Assistant Examiner* — Benjamin Schmitt
(74) *Attorney, Agent, or Firm* — Stanzione & Kim, LLP

(57) ABSTRACT

An electro photographic image forming apparatus includes first and second photosensitive bodies, first and second exposing units to form electrostatic latent images on the first and second photosensitive bodies each of which being charged to a uniform electric potential, a first developing unit to develop the electrostatic latent image on the first photosensitive body by supplying a transparent toner thereto, and a second developing unit to develop the electrostatic latent image on the second photosensitive body by supplying color toners thereto, wherein the first developing unit is a developing unit employing a two-component developing technique using a magnetic carrier and a transparent toner.

23 Claims, 5 Drawing Sheets

ELECTROPHOTOGRAPHIC IMAGE FORMING APPARATUS HAVING TRANSPARENT TONER

CROSS-REFERENCE TO RELATED APPLICATIONS

This application claims the benefit of Korean Patent Application No. 10-2006-0134157, filed on Dec. 26, 2006, in the Korean Intellectual Property Office, the disclosure of which incorporated herein in its entirety by reference.

BACKGROUND OF THE INVENTION

1. Field of the Invention

The present general inventive concept relates to an electrophotographic image forming apparatus having a transparent toner.

2. Description of the Related Art

Electrophotographic image forming apparatuses form an electrostatic latent image by scanning light onto a photosensitive body charged to a uniform electric potential, develop the electrostatic latent image with a predetermined color of toner and then transfer and fuse the developed image to and on a printing medium, thereby printing a desired image. In general, four colors of toners, such as yellow (Y), magenta (M), cyan (C), and black (B), are used in electrophotographic color image forming apparatuses, and four developing units are used to develop the electrostatic latent image formed on the photosensitive body with these four colors of toners.

A toner is manufactured based on a plastic resin and thus has some gloss. A portion of a printed image to which the toner is attached has some gloss but a background region of the printed image to which the toner is not attached has no gloss. In addition, the higher coverage (a ratio of an area to which the toner is attached to an area of the printing medium) of the printed image is, the higher the gloss is. The gloss of the printed image affects the visual quality of the image. U.S. Patent Publication No. 20060127134 discloses an image forming apparatus featuring a transparent image forming station to improve the gloss of a printed image by employing developing devices for developing electrostatic images with color toners and a developing device for developing an electrostatic image with a transparent toner.

SUMMARY OF THE INVENTION

The present general inventive concept provides a printing method for an electrophotographic image forming apparatus having an improved structure in which deterioration of a material property of a transparent toner is prevented.

Additional aspects and utilities of the present general inventive concept will be set forth in part in the description which follows and, in part, will be obvious from the description, or may be learned by practice of the general inventive concept.

The foregoing and/or other aspects and utilities of the present general inventive concept may be achieved by providing an electrophotographic image forming apparatus including first and second photosensitive bodies, first and second exposing units to form electrostatic latent images on the first and second photosensitive bodies each of which being charged to a predetermined electric potential, a first developing unit to develop the electrostatic latent image on the first photosensitive body by supplying a transparent toner thereto, and a second developing unit to develop the electrostatic latent image on the second photosensitive body by supplying color toners thereto, wherein the first developing unit is a developing unit employing a two-component developing technique using a magnetic carrier and a transparent toner.

The apparatus may further include a plurality of the second photosensitive bodies, and a plurality of the second developing units developing the electrostatic latent images on the second photosensitive bodies by supplying different color toners thereto.

The apparatus may further include a plurality of the second exposing units forming electrostatic latent images on the second photosensitive bodies.

The first photosensitive body may be positioned on an upper stream side than the plurality of the second photosensitive bodies in a progressive direction of a transfer medium.

The foregoing and/or other aspects and utilities of the present general inventive concept may also be achieved by providing an electrophotographic image forming apparatus including a photosensitive body, an exposing unit to form an electrostatic latent image on the photosensitive body charged to a uniform electric potential, a first developing unit to develop the electrostatic latent image on the photosensitive body by supplying a transparent toner thereto, and a second developing unit to develop the electrostatic latent image on the photosensitive body by supplying color toners thereto, wherein the first developing unit is a developing unit employing a two-component developer comprising a magnetic carrier and a transparent toner.

The foregoing and/or other aspects and utilities of the present general inventive concept may also be achieved by providing an electrophotographic image forming apparatus having a photosensitive body, the apparatus including a first developing unit disposed to supply a transparent toner of a two-component developer to develop a first electrostatic latent image of the photosensitive body as a first image, and a second developing unit disposed to supply a color toner to develop a second electrostatic latent image of the photosensitive body as a second image to form a printing image with the first image.

The first electrostatic latent image may include a background image of the second electrostatic latent image.

The first electrostatic latent image may include a region having an overlap region with the second image and having one of a gray scale level and a color level lower than a reference.

The first electrostatic latent image may include a region to overlap the second electrostatic latent image.

The first electrostatic latent image may not be developed with the color toner.

The second electrostatic latent image may not be developed with the transparent toner.

The second electrostatic latent image may include a color region of at least one of black, magenta, cyan, and yellow.

The first electrostatic latent image may include a non-color region.

The second developing unit may be disposed to supply the color toner to develop the second electrostatic latent image of the photosensitive body after the first developing unit supplies the transparent toner to develop the first electrostatic latent image of the photosensitive body.

The photosensitive body may include a first photosensitive body having the first electrostatic latent image, and a second photosensitive body having the second electrostatic latent image.

The apparatus may further include a regulating unit to regulate a thickness of the transparent toner deposited on the first developing unit; and a second unit to regulate a thickness of the transparent toner deposited on the second developing unit.

The developing unit may include a developing sleeve rotatably disposed to supply the transparent toner, and a magnet to provide a magnet force to the transparent toner.

The two component developer may include a magnet carrier and a transparent toner material.

The first image may be formed to improve a gloss of the printed image, and at least one portion of the first image is detached from the printing medium.

The apparatus may further include a fusing unit to fuse the image on the printing medium, and at least a portion of the first image may be detached from the printing medium when the image is fused to the printing medium.

The apparatus may further include a transfer belt to receive the image from the photosensitive body and to transfer the image to the printing medium.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
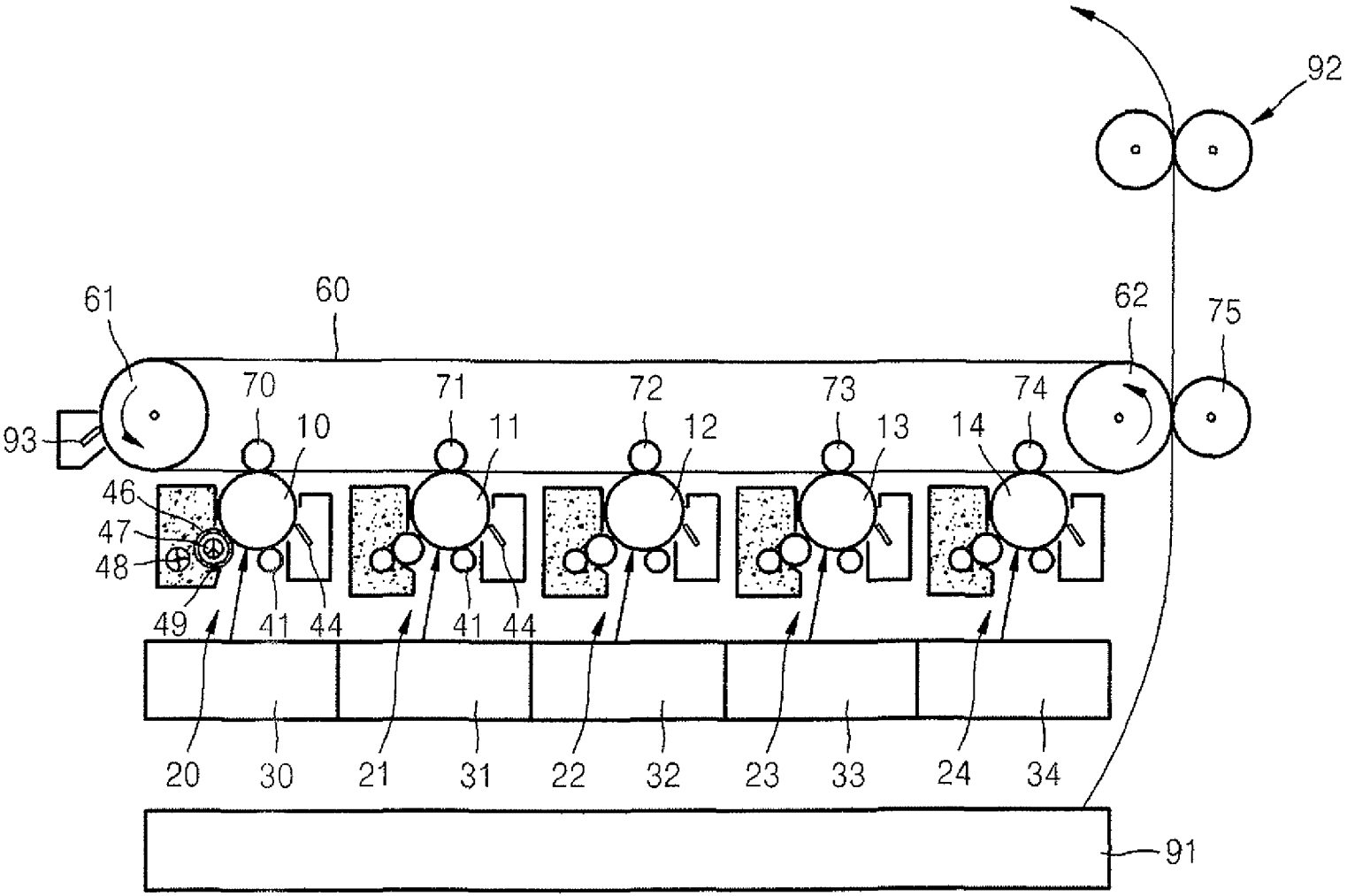
FIG. 1 illustrates a single pass color image forming apparatus which is a type of an electrophotographic image forming apparatus according to an embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

FIG. 1 illustrates an electrophotographic image forming apparatus according to an embodiment of the present general inventive concept. Referring to FIG. 1, the electrophotographic image forming apparatus according to the present embodiment is a single pass color image forming apparatus which comprises a first photosensitive drum 10, a first exposing unit 30, and a first developing unit 20 which are used to develop a transparent toner image, and second photosensitive drums 11, 12,13, and 14, second exposing units 31, 32, 33, and 34, and second developing units 21, 22, 23, and 24 which are used to develop color toner images.

A transparent toner is accommodated in the first developing unit 20. Color toners such as black (B), magenta (M), cyan (C), and yellow (Y) are accommodated in the second developing units 21, 22, 23, and 24, respectively.

The first photosensitive drum 10 and each of the second photosensitive drums 11,12, 13, and 14 are examples of a photosensitive body on which an electrostatic latent image is to be formed, for example, an organic photosensitive body or an Amorphous silicon photosensitive body having a long life span. The first photosensitive drum 10 and each of the second photosensitive drums 11, 12,13, and 14 correspond to the first developing unit 20 and a corresponding one of the second developing units 21, 22, 23, and 24, respectively.

The first exposing unit 30 and each of the second exposing units 31, 32, 33, and 34 scan light modulated according to image information about transparent (T), black (B), magenta (M), cyan (C), and yellow (Y) colors, respectively, onto the first photosensitive drum 10 and the second photosensitive drum 11, 12,13, and 14 and thereby forms electrostatic latent images. A laser scanning unit (LSU) that uses a laser diode as a light source, is usually used as each of the first and second exposing units 30, 31, 32, 33, and 34.

Each of charging rollers 41 is an example of a charging unit to charge a corresponding one of the first photosensitive drum and the second photosensitive drums 11, 12, 13, and 14 to a uniform surface electric potential. The charging rollers 41 are in contact with the first and second photosensitive drums 10, 11, 12, 13, and 14, respectively. A charging bias voltage is applied to each of the charging rollers 41.

The color toners according to the present embodiment are mono-component toners. A colorant for causing a change in color of a binder resin, internal additives such as charge control agent (CCA), wax or the like, and external additives such as silica and titanium oxide ($TiO_2$) are added to the color toners. Charging amounts of the color toners are about −10 to −25 μC/g measured in suction type Faraday Gauge, and a layer of toner on a developing roller 42 is about 0.5 to 1 $mg/cm^2$. The color toners are charged to a negative (−) or positive (+) polarity.

The case where the color toners are charged to the negative (−) polarity will now be described.

Each of the second developing units 21, 22, 23, and 24 comprises a developing roller 42 and a supply roller 43. The supply roller 43 attaches the toner accommodated in each of the second developing units 21, 22, 23, and 24 to the developing roller 42. The second developing units 21, 22, 23, and 24 may further comprise a regulating unit 45 which regulates the amount of the toner attached to the surface of the developing roller 42 to form a layer of toner having a uniform thickness. For example, the regulating unit 45 may be an elastic plate or roller which is elastically in contact with the developing roller 42. In addition, the second developing units 21, 22, 23, and 24 may further comprise at least one carrying unit (not shown) which carries the toner accommodated in each of the second developing units 21, 22, 23, and 24 into a region in which the developing roller 42 and the supply roller 43 face each other. When a contact developing technique is used, the developing rollers 42 are in contact with the corresponding ones of the second photosensitive drums 11, 12, 13, and 14. A developing bias voltage, which is used to supply the color toners accommodated in each of the second developing units 21, 22, 23, and 24 to electrostatic latent images of the second photosensitive drums 11, 12, 13, and 14, is applied to each of the developing rollers 42. Due to the developing bias voltage, an electric potential difference between the developing rollers 42 and the electrostatic latent images is produced so that the toners are detached from the surface of the developing rollers 42 and are attached to the electrostatic latent images such that the electrostatic latent images are developed with the toners. When a non-contact developing technique is used, each of the developing rollers 42 is positioned to maintain a developing gap between each of the second photosensitive drums 11, 12, 13, and 14, and for example, a bias voltage in which an AC current and a DC current are mixed, may be used as a developing bias voltage.

A composition of the transparent toner is almost the same as the composition of the color toners except for the colorant. However, since a molecular weight of a binder resin of the transparent toner is lower than a molecular weight of a binder resin of the color toners, and a content of wax of the transparent toner is greater than a content of wax of the color toners, the transparent toner has weak durability compared to the color toners. The color toners and the transparent toner are charged to a negative (−) or positive (+) polarity. According to a mono-component developing technique, the toner is supplied to the surface of the developing roller 42 by friction between the supply roller 43 and the developing roller 42, and a uniform layer of toner is formed by the regulating unit 45 that elastically contacts the surface of the developing roller 42. As described above, since the transparent toner has weak durability, when the mono-component developing technique is employed, a charging characteristic may be deteriorated by repeated friction between the supply roller 43 and the developing roller 42 and between the developing roller 42 and the regulating means 45. Then, since the developing property of the transparent toner is lowered, gloss of the printed image may be lowered. In addition, the gloss of the printed image may be lowered. In this consideration, a two-component developing unit employing two-component developer comprising a magnetic carrier and a transparent toner can be used as the first developing unit 20 to develop the image with the transparent toner.

Figure 2:
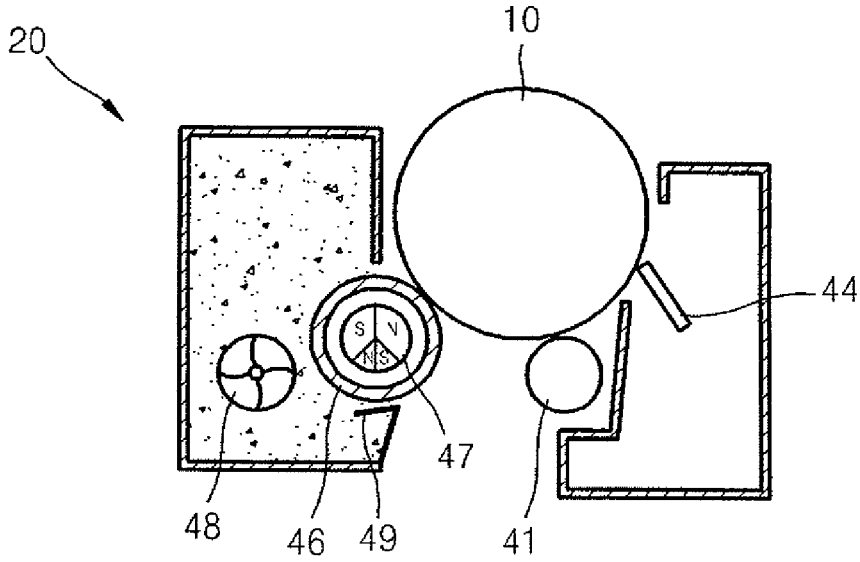
FIG. 2 illustrates the structure of a first developing unit of the image forming apparatus of FIG. 1.
Figure 3:
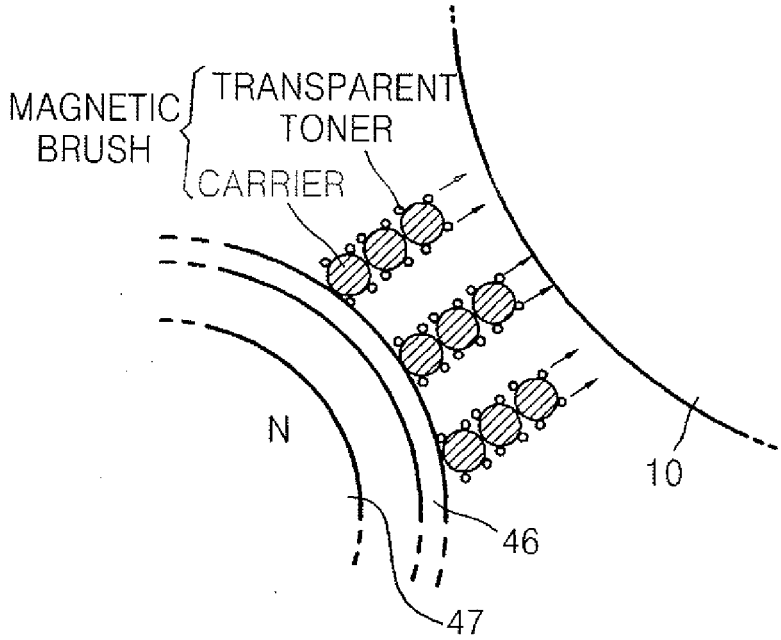
FIG. 3 illustrates an operation of developing a transparent toner by using the first developing unit of FIGS. 1 and 2.

The transparent toner and the magnetic carrier are accommodated in the first developing unit 20. Referring to FIG. 2, the first developing unit 20 comprises a developing sleeve 46 in which a magnet 47 is installed. The developing sleeve 46 is made of a conductive metal such as aluminum. The developing sleeve 46 is rotated. At least one agitator 48 is disposed in the first developing unit 12. The agitator 48 agitates the magnetic carrier and the transparent toner in the first developing unit 20. As such, the transparent toner is charged to a negative (−) polarity, for example. As illustrated in FIG. 3, the magnetic carrier is attached to an outer circumference of the developing sleeve 46 by a magnetic force of the magnet 47. The transparent toner is attached to the surface of the magnetic carrier by an electrostatic force. As such, a magnetic brush having the magnetic carrier and the transparent toner is formed on the surface of the developing sleeve 46. Since a regulating unit 49 does not contact the surface of the developing sleeve 46, a stress applied to the transparent toner by the regulating unit 49 may be much smaller than a stress applied to the regulating unit 45 that elastically contacts the surface of the developing roller 42. Thus, deterioration of performance of the transparent toner can be prevented. In addition, since the magnetic carrier and the transparent toner are continuously agitated in the first developing unit 20 and are charged, a stress applied to the transparent toner can be reduced compared to a mono-component developing technique in which the transparent toner is charged by friction between the supply roller 43 and the developing roller 42 and a charging amount can be maintained to a very uniform and high level.

An intermediate transfer belt 60 is an example of an intermediate transfer medium to which toner images developed on the first and second photosensitive drums 10, 11, 12, 13, and 14 are temporarily transferred. The intermediate transfer belt 60 faces the first and second photosensitive drums 10, 11, 12, 13, and 14, is supported by support rollers 61 and 62 and travels in a circulative path. A first transfer roller 70 faces the first photosensitive drum 10 in a state where the intermediate transfer belt 60 is placed therebetween. Each of second transfer rollers 71, 72, 73, and 74 faces a corresponding one of the second photosensitive drums 11, 12, 13, and 14 in a state where the intermediate transfer belt 60 is placed therebetween. A first transfer bias voltage, which is used to attach the toner images developed on the first and second photosensitive drums 10, 11, 12, 13, and 14 to the intermediate transfer belt 60, is applied to each of the first and second transfer rollers 70, 71, 72, 73, and 74. For example, a conductive metal roller or a rubber roller in which a semi-conductive rubber having elasticity is disposed on a metal shaft may be used as each of the first and second transfer rollers 70, 71, 72, 73, and 74.

A final transfer roller 75 is positioned to face the intermediate transfer belt 60. A printing medium stacked on a paper feeding cassette 91 is carried by a carrying unit (not shown) between the final transfer roller 75 and the intermediate transfer belt 60. A second transfer bias voltage, which is used to transfer the toner images attached to the intermediate transfer belt 60 to the printing medium, is applied to the final transfer roller 75. A fusing unit 92 fuses the toner images on the printing medium by applying heat and pressure to the printing medium.

A cleaning blade 44 is an example of a cleaning unit which eliminates the toner remaining on the surface of each of the first and second photosensitive drums 10, 11, 12, 13, and 14 after an intermediate transfer operation.

Operation and effect by using the above-described structure will now be described.

When a printing instruction is input, image information is processed to image information about transparent (T), black (B), magenta (M), cyan (C), and yellow (Y) colors by a control unit (not shown). The image information about a transparent (T) color may be image information, which is used to develop a transparent toner image in a region which corresponds to a background portion of an image in which color toners such as black (B), magenta (M), cyan (C), and yellow (Y) are not attached. In order to make the gloss of the printed image uniform, image information about a transparent (T) color may be image information, which is used to develop a transparent toner image in a region in which the amount of attachment of color toners of black (B), magenta (M), cyan (C), and yellow (Y) is low and/or in a region which corresponds to a background portion of the image.

Figure 4:
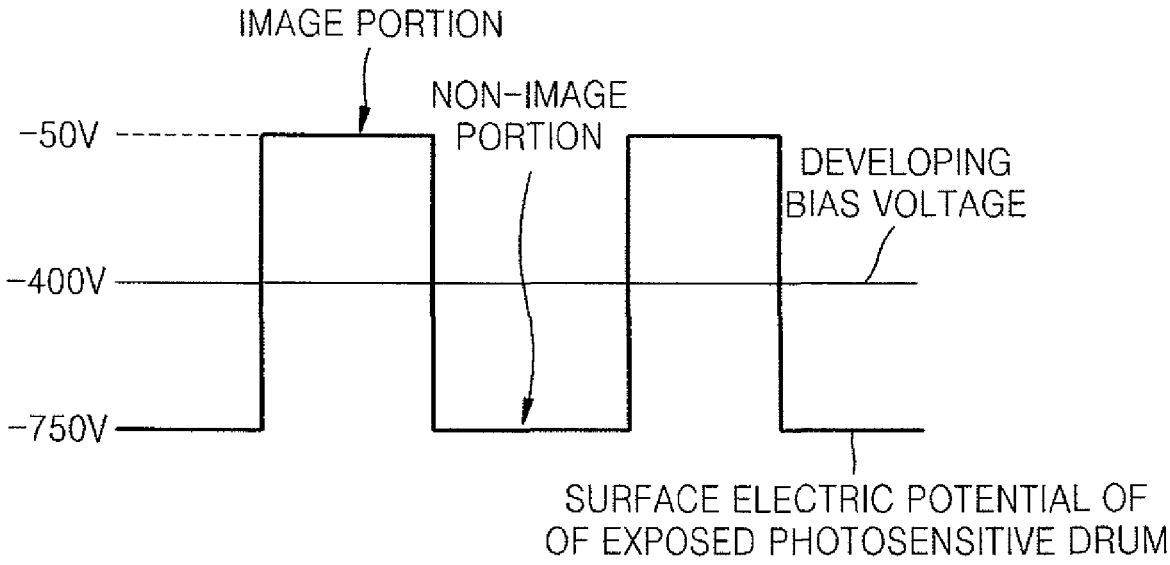
FIG. 4 illustrates an electric potential of the surface of an exposed photosensitive drum of FIGS. 1, 2, and 3.

According to the image information about the transparent (T) color, the first exposing unit 30 scans light onto the first photosensitive drum 10 charged by the charging roller 41 to a uniform electric potential and thereby forms an electrostatic latent image. For example, the surface electric potential of the first photosensitive drum 10 charged by the charging roller 41 is approximately −750V, as illustrated in FIG. 4. The electric potential of an image portion onto which light is scanned by the first exposing unit 30 is, for example, approximately −50V. A non-image portion onto which light is not scanned is maintained at the surface electric potential of the charged first photosensitive drum 10. The magnetic carrier and the transparent toner in the first developing unit 20 are agitated by the agitator 48 and the transparent toner is charged to a negative (−) polarity, for example. As illustrated in FIG. 3, a magnetic brush is formed on the outer circumference of the developing sleeve 46 by a magnetic force of the magnet 47 and by an electrostatic force between the magnetic carrier and the transparent toner. When the magnetic brush whose height is limited by the regulating unit 49 to a uniform level reaches a developing region in which the developing sleeve 46 and the first photosensitive drum 10 face each other, the transparent toner is separated from the magnetic brush by a developing bias voltage applied to the developing sleeve 46 and is attached to the image portion of the first photosensitive drum 10. A first transfer bias voltage having an opposite polarity to the charging polarity of the transparent toner is applied to the first transfer roller 70. As such, a transparent toner image developed on the first photosensitive drum 10 is transferred to the intermediate transfer belt 60.

Next, for example, according to the image information about the black (B) color, the second exposing unit 31 scans light onto the second photosensitive drum 11 charged by the charging roller 41 to a uniform electric potential and thereby forms an electrostatic latent image. For example, the surface electric potential of the charged second photosensitive drum 11 is identical with that illustrated in FIG. 4. The electric potential of an image portion in which light is scanned by the second exposing unit 31 is, for example, approximately −50 V. A non-image portion in which light is not scanned by the second exposing unit 31 is maintained to the electric potential of the surface of the charged second photosensitive drum 11. The average electric potential of the developing bias voltage to be applied to each developing roller 42 of the second developing unit 21 is between the electric potential of the image portion and the electric potential of the non-image portion. Since the black toner is charged to a negative (−) polarity, when the developing bias voltage is applied to the developing roller 42, the black toner accommodated in the first developing unit 21 is attached to the image portion. A first transfer bias voltage having an opposite polarity to the charging polarity of the black toner is applied to the second transfer roller 71. As such, the black toner image developed on the second photosensitive drum 11 is transferred to the intermediate transfer belt 60. The black toner that remains on the second photosensitive drum 11 after a transfer operation is eliminated by the cleaning blade 44.

The same operation as described above is performed by the second photosensitive drums 12, 13, and 14, the second exposing units 32, 33, and 34, and the second developing units 22, 23, and 24, respectively, at time intervals each of which is given by the formula (distance between photosensitive drums)/(carrying speed of intermediate transfer belt), so as to meet color registration requirements.

Through the above-described operations, the transparent toner image and the color toner images are sequentially stacked on the intermediate transfer belt 60. At a time in which the color toner images reach a region in which the final transfer roller 75 and the intermediate transfer belt 60 face each other, the printing medium supplied from the paper feeding cassette 91 reaches the region. A second transfer bias voltage having an opposite polarity to the charging polarities of the first transparent toner image and the color toner images are applied to the final transfer roller 75. Then, the toner images are transferred to the printing medium. When the printing medium passes the fusing unit 92, the transparent toner image and the color toner images are fused on the printing medium by heat and pressure and a printing operation is completed. Since the color toners that are not transferred to the printing medium and remain on the intermediate transfer belt 60 are eliminated by a cleaning member 93, the color toner images are not mixed in the first and second developing units 20, 21, 22, 23, and 24 through the first and second photosensitive drums 10, 11, 12, 13, and 14.

A difference in gloss between the background region and the region in which the black (B), magenta (M), cyan (C), and yellow (Y) toner images are attached can be reduced through the above-described operations so that the quality of the printed image can be improved. In this way, in the image forming apparatus according to the present general inventive concept, the transparent toner image having weak durability compared to the color toners is developed by using the first developing unit 20 employing a two-component developing technique so that deterioration of performance of the transparent toner can be reduced and the developing property of the transparent toner can be maintained for a longer period of time. Thus, an image having uniform quality and high gloss can be printed for a life span. Each of the second developing units 21, 22, 23, and 24 may use one of a mono-component contact or non-contact developing technique or a two-component technique. For example, each of the second developing units 21, 22, 23, and 24 may employ a mono-component contact developing technique or mono-component non-contact developing technique so as to miniaturize an image forming apparatus.

In addition, the transparent toner image may be firstly developed and transferred onto the intermediate transfer belt 60 and then, the color toner images may be transferred onto the intermediate transfer belt 60 so that the fusing unit 92 can be easily separated from the printing medium after the printing medium passes the fusing unit 92. To this end, the first photosensitive drum 10 is positioned on an upper stream side than the second photosensitive drums 11, 12, 13, and 14 in a progressive direction of the intermediate transfer belt 60 and may be first transferred onto the intermediate transfer belt 60. Then, when the transparent toner image is finally transferred to the printing medium, the transparent toner image is positioned on the uppermost side. Since the transparent toner has a lower molecular weight than the molecular weight of the color toners and has a much content of wax than the content of wax of the color toners so as to improve the gloss as described above, the transparent toner image is more easily detached from the fusing unit 92. Thus, an offset defect of an image in which the toner image fused on the printing medium is attached to the fusing unit 92 and is detached from the printing medium in the fusing operation or a jam in the fusing unit 92 can be prevented.

Figure 5:
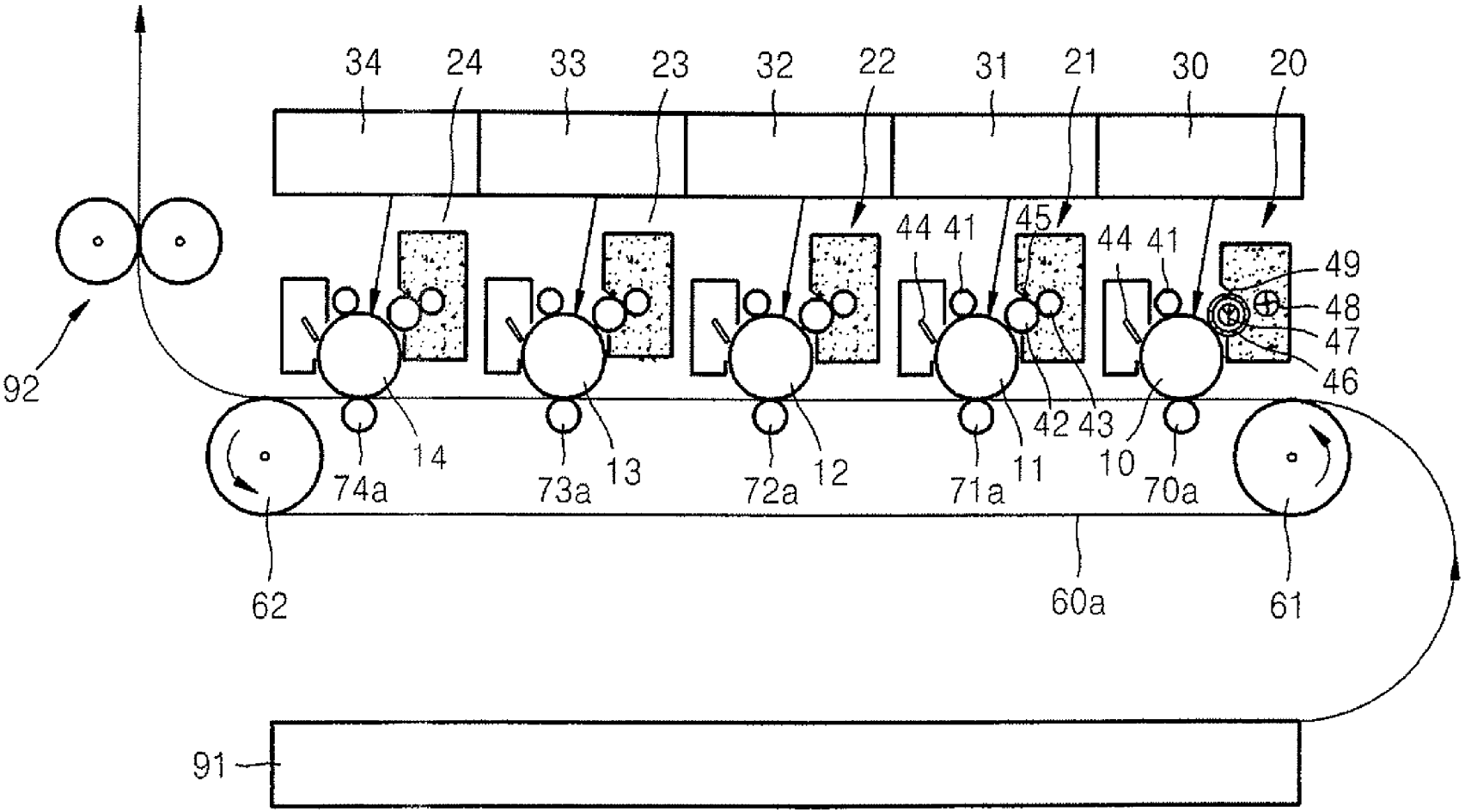
FIG. 5 illustrates a single pass color image forming apparatus employing a direct transfer technique which is a type of an electrophotographic image forming apparatus, according to another embodiment of the present general inventive concept.

The above-described technique for developing the transparent toner may also be applied to a single pass image forming apparatus employing a direct transfer technique in which the toner image is directly transferred to the printing medium without an intermediate transfer operation, as illustrated in FIG. 5. Referring to FIG. 5, the printing medium picked-up and/or fed from the paper feeding cassette 91 is carried by a carrying belt 60*a*. Each of the transfer rollers 70*a*, 71*a*, 72*a*, 73*a*, and 74*a* faces each of the first and second photosensitive drums 10, 11, 12, 13, 14, and 15 in the state where the printing medium and the carrying belt 60*a* are placed therebetween. The transparent toner image and the color toner images respectively developed on the first and second photosensitive drums 10, 11, 12, 13, 14, and 15 are directly transferred to the printing medium by a transfer bias voltage applied to each of the transfer rollers 70*a*, 71*a*, 72*a*, 73*a*, and 74*a*.

Figure 6:
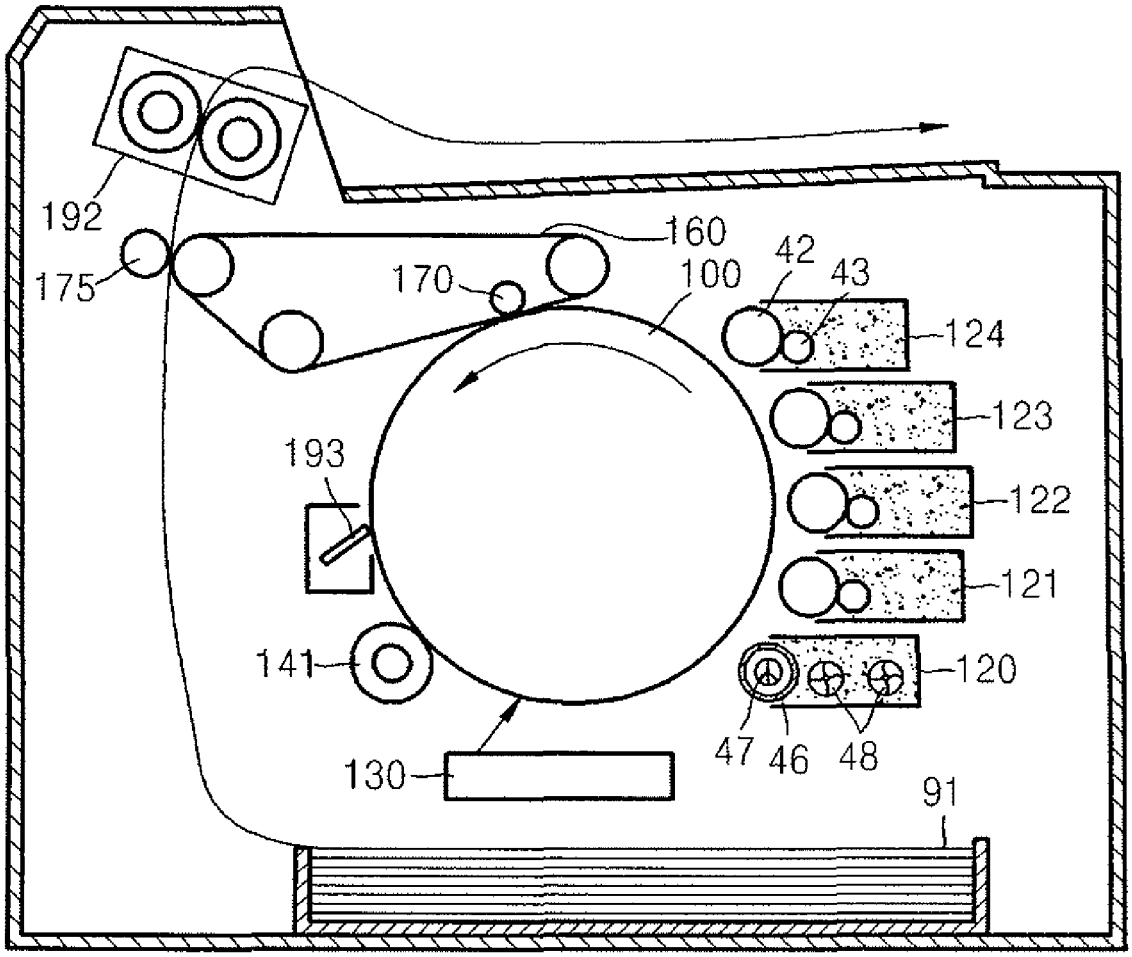
FIG. 6 illustrates a multiple pass color image forming apparatus which is a type of an electrophotographic image forming apparatus according to another embodiment of the present general inventive concept.

The above-described technique for developing the transparent toner may also be applied to a multiple pass image forming apparatus. FIG. 6 illustrates an electrophotographic image forming apparatus according to another embodiment of the present general inventive concept. The electrophotographic image forming apparatus according to the present embodiment comprises a photosensitive drum 100, an exposing unit 130, a first developing unit 120 to develop a transparent toner image, and four second developing units 121, 122,123, and 124 to develop color toner images. Referring to FIG. 6, the first and second developing units 120, 121, 122, 123, and 124 are disposed around the photosensitive drum 100. A transparent toner is accommodated in the first developing unit 120. Color toner images such as black (B), magenta (M), cyan (C), and yellow (Y) are accommodated in the second developing units 121, 122, 123, and 124, respectively.

The first developing unit 120 is a developing unit employing a two-component developing technique as described with reference to FIGS. 2 and 3. In addition, the transparent toner image may be firstly developed and transferred onto the intermediate transfer belt 160 from the photosensitive drum 100 so that the transparent toner image can be easily detached from the printing medium. Thus, firstly, the exposing unit 130 scans light onto the photosensitive drum 100 charged by a charging roller 141 to a uniform electric potential according to transparent (T) image information and thereby forms an electrostatic latent image corresponding to the transfer toner image on the surface of the photosensitive drum 100. A transparent toner image is formed on the surface of the photosensitive drum 100 by the transparent toner supplied by the first developing unit 120. The transparent toner image is transferred onto the intermediate transfer belt 160 by a first transfer bias voltage applied to the intermediate transfer roller 170.

Next, the exposing unit 130 scans light onto the photosensitive drum 100 charged by a charging roller 141 to a uniform electric potential according to black (B) image information, for example, and thereby forms an electrostatic latent image corresponding to black (B) on the surface of the photosensitive drum 100. When the black (B) toner is supplied to the electrostatic latent image by the second developing unit 121, a black toner image is formed on the surface of the photosensitive drum 100. The black toner image is transferred onto the intermediate transfer belt 160 by the first bias voltage applied to the intermediate transfer roller 170. The cleaning member 193 eliminates a black toner that remains on the photosensitive drum 100 after a transfer operation. When the black toner image which corresponds to a sheet of paper is transferred onto the intermediate transfer belt 100, toner images of magenta (M), cyan (C), and yellow (Y) colors are sequentially transferred onto the intermediate transfer belt 160 through the same operation. As such, color toner images are formed on the intermediate transfer belt 160. The toner images are transferred to the printing medium using the final transfer roller 175 and are fused on the fusing unit 192 so that color images having improved gloss can be printed. The feature of the present general inventive concept is to improve the utilization efficiency of the transparent toner. Thus, the scope of the present general inventive concept is not limited by the above-described developing sequence of magenta (M), cyan (C), and yellow (Y) toners.

Each of the second developing units 121, 122, 123, and 124 may use one of a contact developing technique in which the developing roller 42 and the photosensitive drum 100 contact each other, a non-contact developing technique in which the developing roller 42 and the photosensitive drum 100 are separated from each other by a developing gap or a two-component developing technique. When a contact developing technique developing unit is employed as each of the second developing units 121, 122, 123, and 124, each of the second developing units 121,122, 123, and 124 may move to a location in which the developing roller 42 is separated from the photosensitive drum 100 while not performing a developing operation.

Only the color image forming apparatus employing a plurality of second developing units has been described in the above-described embodiments. However, the scope of the present invention is also not limited to this. The present general inventive concept may also be applied to a single color image forming apparatus employing a single second developing unit. In addition, the scope of the present general inventive concept is not limited by the above-described developing sequence of black (B), magenta (M), cyan (C), and yellow (Y) toners.

As described above, in the electrophotographic image forming apparatus according to the present invention, the transparent toner image is developed using a two-component developing unit such that lowering of a developing property caused by deterioration of performance of the transparent toner is prevented and a printed image having high gloss is printed. In addition, the transparent toner image is firstly developed so that it can be easily detached from the fusing unit during a fusing operation. Therefore, the offset defect of an image fused on the printing medium and the jam in the fusing unit can be prevented.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An electro photographic image forming apparatus comprising:

first and second photosensitive bodies;

first and second exposing units to form electrostatic latent images on the first and second photosensitive bodies each of which being charged to a predetermined electric potential;

a first developing unit to develop the electrostatic latent image on the first photosensitive body by supplying a transparent toner thereto; and a second developing unit to develop the electrostatic latent image on the second photosensitive body by supplying color toners thereto, wherein the first developing unit is a developing unit employing a two-component developer as the transparent toner comprising a magnetic carrier and a transparent toner material, and the second developing unit is a developing unit employing a mono-component developer, wherein:

the second photosensitive body comprises a plurality of the second photosensitive bodies; and the second developing unit comprises a plurality of the second developing units to develop corresponding ones of the electrostatic latent images on the second photosensitive bodies by supplying different color toners comprising black toner, yellow toner, magenta toner, and cyan toner, thereto.

2. The apparatus of claim 1, wherein the second exposing unit comprises a plurality of the second exposing units to form electrostatic latent images on corresponding ones of the second photosensitive bodies.

3. The apparatus of claim 1, wherein the first photosensitive body is positioned on an upper stream side than the plurality of the second photosensitive bodies in a progressive direction of a transfer medium.

4. An electro photographic image forming apparatus comprising:

a single photosensitive body;

a single exposing unit to form first and second electrostatic latent images sequentially on the single photosensitive body charged to a uniform electric potential;

a first developing unit to develop the first electrostatic latent image on the single photosensitive body by supplying a transparent toner thereto;

a second developing unit to develop the second electrostatic latent image on the single photosensitive body by supplying color toners thereto, and an intermediate transfer belt on which the developed transparent image and color image are transferred, wherein the first developing unit is a developing unit employing a two-component developer comprising a magnetic carrier and a transparent toner material, and the second developing unit is a developing unit employing a mono-component developer, wherein the second developing unit comprises a plurality of the second developing units to develop corresponding ones of the electrostatic latent images on the single photosensitive body by supplying different color toners comprising black toner, yellow toner, magenta toner, and cyan toner, thereto.

5. An electro photographic image forming apparatus having a photosensitive body, comprising:

a first developing unit disposed to supply a transparent toner of a two-component developer to develop a first electrostatic latent image of the photosensitive body as a first image; and a plurality of second developing units disposed to supply color toners of a mono-component developer to develop second electrostatic latent images of the photosensitive body as second images to form a printing image with the first image, the color toners comprising black toner, yellow toner, magenta toner, and cyan toner.

6. The apparatus of claim 5, wherein the first electrostatic latent image comprises a background image of the second electrostatic latent image.

7. The apparatus of claim 5, wherein the first electrostatic latent image comprises a region having an overlap region with the second images.

8. The apparatus of claim 5, wherein the second electrostatic latent images are not developed with the transparent toner.

9. The apparatus of claim 5, wherein the first electrostatic latent image comprises a non-color region.

10. The apparatus of claim 5, wherein the second developing units are disposed to supply the color toners to develop the second electrostatic latent images of the photosensitive body after the first developing unit supplies the transparent toner to develop the first electrostatic latent image of the photosensitive body.

11. The apparatus of claim 5, wherein the photosensitive body comprises a first photosensitive body having the first electrostatic latent image, and second photosensitive bodies having the second electrostatic latent images, respectively.

12. The apparatus of claim 5, further comprising:

a regulating unit to regulate a thickness of the transparent toner deposited on the first developing unit; and second units to regulate a thickness of the color toners deposited on the second developing units.

13. The apparatus of claim 5, wherein the first developing unit comprises a developing sleeve rotatably disposed to supply the transparent toner, and a magnet to provide a magnet force to the transparent toner.

14. The apparatus of claim 5, wherein the two component developer comprises a magnet carrier and a transparent toner material.

15. The apparatus of claim 5, wherein the first image is formed to improve a gloss of the printed image.

16. The apparatus of claim 5, further comprising:

a fusing unit to fuse the image on the printing medium, wherein at least a portion of the first image is detached from the printing medium when the image is fused to the printing medium.

17. The apparatus of claim 5, further comprising:

a transfer belt to receive the image from the photosensitive body and to transfer the image to the printing medium.

18. An electro photographic image forming apparatus, comprising:

a first developing unit disposed to supply a transparent toner with a first developing characteristic to develop a first electrostatic latent image of a first photosensitive body as a first image;

second developing units disposed to supply color toners of a second developing characteristic to develop second electrostatic latent images of second photosensitive bodies as second images to form a printing image with the first image on a medium;

a first cleaning unit disposed in the first developing unit to clean the first photosensitive body; and a second cleaning unit disposed in each of the second developing units to clean the second photosensitive bodies, wherein:

the transparent toner comprises a two-component developer having the first developing characteristic;

the color toners comprise a mono-component developer having the second developing characteristic; and the color toners comprise black toner, yellow toner, magenta toner, and cyan toner.

19. The apparatus of claim 18, wherein each of the second developing units comprise a developing roller without a magnet.

20. The apparatus of claim 18, wherein the first developing unit has a magnet, and the second developing units do not have a magnet.

21. The apparatus of claim 18, wherein the first photosensitive body and the second photosensitive bodies are formed in a single body.

22. The apparatus of claim 18, wherein the first developing characteristic has a first durability and the second developing characteristic has second durability higher than the first durability.

23. The apparatus of claim 18, wherein the first cleaning unit removes the transparent toner from the first photosensitive body, and the second cleaning unit removes the color toners from the second sensitive bodies.

* * * * *